US011390076B2

(12) United States Patent
Chen et al.

(10) Patent No.: US 11,390,076 B2
(45) Date of Patent: Jul. 19, 2022

(54) FLUID FEED PATH WETTABILITY COATING

(71) Applicant: Hewlett-Packard Development Company, L.P., Spring, TX (US)

(72) Inventors: Chien-Hua Chen, Corvallis, OR (US); Michael G. Groh, Corvallis, OR (US); Zhizhang Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 128 days.

(21) Appl. No.: 16/955,600

(22) PCT Filed: Feb. 6, 2019

(86) PCT No.: PCT/US2019/016850
§ 371 (c)(1),
(2) Date: Jun. 18, 2020

(87) PCT Pub. No.: WO2020/162927
PCT Pub. Date: Aug. 13, 2020

(65) Prior Publication Data

US 2021/0229439 A1 Jul. 29, 2021

(51) Int. Cl.
*B41J 2/14* (2006.01)

(52) U.S. Cl.
CPC ..... *B41J 2/14145* (2013.01)

(58) Field of Classification Search
CPC ..... B41J 2/1606; B41J 2/1637; B41J 2/1642; B41J 2/1626; B41J 2/1631; B41J 2/1632; B41J 2/1603; B41J 2/14145; B41J 2202/20
See application file for complete search history.

(56) References Cited

U.S. PATENT DOCUMENTS 8,333,459 B2 12/2012 Rivas et al.
8,567,909 B2 10/2013 Sieber
8,585,180 B2 11/2013 Bhowmik et al.
(Continued)

FOREIGN PATENT DOCUMENTS

EP 2753471 10/2016
JP 2014124887 7/2014
WO 2016122620 8/2016

OTHER PUBLICATIONS

International Searching Authority, "International Search Report," issued in connection with International Patent Application No. PCT/US2019/016850, dated Nov. 8, 2019, 6 pages.
(Continued)

*Primary Examiner* — An H Do
(74) *Attorney, Agent, or Firm* — Hanley Flight & Zimmerman LLC

(57) ABSTRACT

Fluid feed paths having enhanced wettability characteristics are disclosed. An example printhead includes a nozzle to expel fluid therefrom, and a fluid feed path to fluidly couple a fluid source and the nozzle. Fluid feed path walls are composed of a first material having a first wettability characteristic and a second material having a second wettability characteristic. The second wettability characteristic differing from the first wettability characteristic. A coating is formed on at least a portion of the fluid feed path defined by the first material and the second material of the substrate. The coating to harmonize the first wettability characteristic and the second wettability characteristic.

20 Claims, 10 Drawing Sheets

(56) References Cited

U.S. PATENT DOCUMENTS

| | | | |
|---|---|---|---|
| 8,840,981 | B2 | 9/2014 | Sieber |
| 9,174,432 | B2 | 11/2015 | Liu et al. |
| 2011/0018938 | A1 | 1/2011 | Rivas et al. |
| 2014/0168336 | A1 | 6/2014 | Mettu et al. |
| 2015/0062237 | A1 | 3/2015 | Kondo et al. |
| 2016/0136957 | A1 | 5/2016 | North et al. |
| 2017/0072692 | A1 | 3/2017 | Chen et al. |
| 2018/0281425 | A1 | 10/2018 | Chen et al. |

OTHER PUBLICATIONS

International Searching Authority, "Written Opinion," issued in connection with International Patent Application No. PCT/US2019/016850, dated Nov. 8, 2019, 7 pages.

FLUID FEED PATH WETTABILITY COATING

RELATED APPLICATIONS

This patent arises from a U.S. national stage of International Patent Application Serial No. PCT/US19/16850, having a filing date of Feb. 6, 2019, which is hereby incorporated by reference in its entirety.

BACKGROUND

Fluid ejection devices in printers provide drop-on-demand ejection of fluid droplets. Printers may include 2D and 3D printers or any other fluid ejection application for example in the field of pharmaceutics, forensics, and/or laboratories. Suitable fluids for 2D and 3D printing applications may include inks, agents.

In general, printers print images or objects by ejecting droplets through a plurality of nozzles onto a print medium, such as a sheet of paper or (layers of) build material. The nozzles are arranged in an array, such that properly sequenced ejection of droplets from the nozzles causes patterns to be printed on the print medium as the printhead and the print medium move relative to each other.

Figure 1:
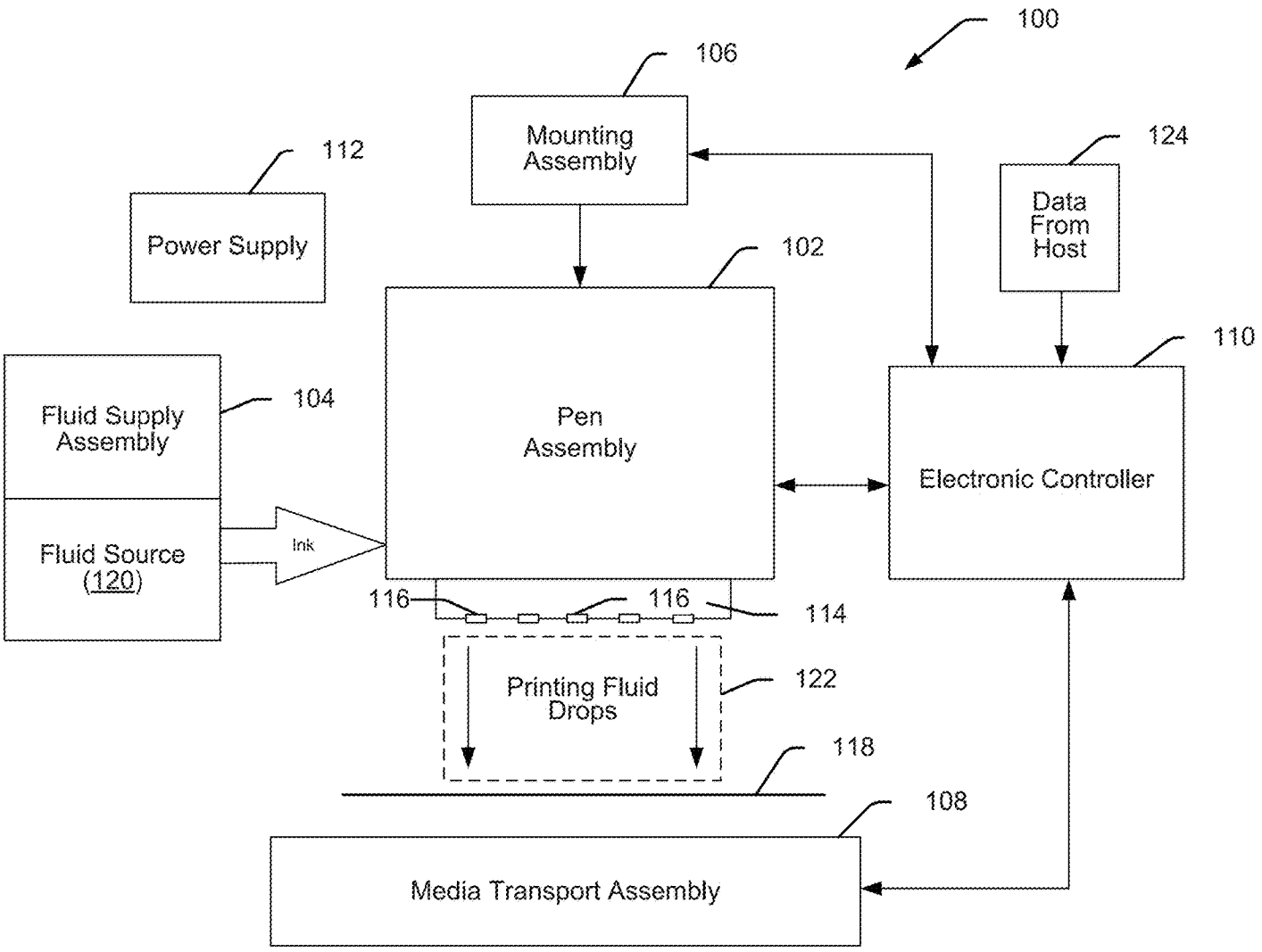
FIG. 1 is a block diagram an example printing system that can include an example pen assembly in accordance with teachings of this disclosure.

The figures are not to scale. Instead, the thickness of the layers or regions may be enlarged in the drawings. In general, the same reference numbers will be used throughout the drawing(s) and accompanying written description to refer to the same or like parts. Although the figures show layers and regions with clean lines and boundaries, some or all of these lines and/or boundaries may be idealized. In reality, the boundaries and/or lines may be unobservable, blended, and/or irregular.

DETAILED DESCRIPTION

Certain examples are shown in the identified figures and disclosed in detail herein. Although the following discloses example methods and apparatus, it should be noted that such methods and apparatus are merely illustrative and should not be considered as limiting the scope of this disclosure.

As used herein, directional terms, such as "upper," "lower," "top," "bottom," "front," "back," "leading," "trailing," "left," "right," etc. are used with reference to the orientation of the figures being described. Because components of various examples disclosed herein can be positioned in a number of different orientations, the directional terminology is used for illustrative purposes and is not intended to be limiting. Descriptors "first," "second," "third," etc. are used herein when identifying multiple elements or components which may be referred to separately. Unless otherwise specified or understood based on their context of use, such descriptors are not intended to impute any meaning of priority or ordering in time but merely as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

Printing systems feed printing fluid (e.g., ink) through a printhead to a firing port. While the printing fluid is fed through the printhead, such as through a channel that extends through a substrate, the printing fluid contacts walls of the substrate defining the channel. For example, printheads, pens, and/or other ink dispensing apparatus include chambers that receive printing fluid via a fluid feed path (e.g., an ink feed path) and dispense the printing fluid from a firing chamber via a nozzle. The components defining the fluid feed path, the nozzle, and the firing chamber are often formed of semiconductor material(s).

To protect a substrate from the printing fluid, some substrates employ a protective coating. For example, printing fluid including a pigmented ink having charged dispersants can etch surfaces (e.g., walls of a channel) of the substrate (e.g., a silicon substrate) such that the substrate leaches into the pigmented ink. Presence of substrate particles or material in the printing fluid can cause a blockage or partial blockage of a firing port of a printhead. To reduce such blockage or partial blockage of the firing port to improve the print quality of the printing device, some substrates employ a protective coating to protect the substrate material from printing fluid (e.g., ink attack). For example, some printhead apparatus employ an ink feed path coated with hafnium oxide to protect a substrate (e.g., a silicon (Si) substrate) from ink attack. However, application of the hafnium oxide coating is relatively a slow process. The greater a thickness of the protective layer, the longer the manufacturing time to apply the protective material.

To improve performance (e.g., higher refill speed) and/or significantly reduce bubble trapping, example pens or fluid ejection devices (e.g., a thermal-ink-jet (TIJ) pen or a cartridge) disclosed herein include fluid feed paths having enhanced wettability characteristics. To enhance wettability characteristics of a fluid feed path, example fluid feed paths of fluid ejection devices disclosed herein employ a wettability enhancement coating. In some examples, the wettability enhancement coating is applied along an entire length of a fluid feed path between a fluid source (e.g., a reservoir, an ink reservoir, a dispenser, a pipette, a continuous fluid source) and a nozzle of a printhead. In some examples, the wettability enhancement coating is applied along a portion (i.e., a partial length) of a fluid feed path between a fluid reservoir (e.g., an ink reservoir) and a nozzle of a printhead.

In some examples, a fluid feed path disclosed herein can be defined by a die or substrate made from different materials (e.g., silicon (Si), Epoxy Mold Compound (EMC), photoresist (SU8), etc.) that may have different and/or inferior wettability characteristics compared to the wettability enhancement coating disclosed herein. For example, example substrates or dies disclosed herein include a fluid feed path defined by a slot in a carrier, a fluid feed hole coupling the slot to a firing chamber, and a nozzle to expel ink from the firing chamber. For example, the slot can be defined by a carrier of molded compound such as EMC material. An array of fluid feed holes can be formed in a substrate, for example of Si material. The firing chamber and nozzle can be formed by a thin film layers, for example including SU8 material. All three materials possess different wettability characteristics. The example wettability enhancing coating disclosed herein harmonizes or provides homogenous or identical wettability characteristics of the substrate to improve pen performance. As used herein, to "harmonize or provide homogenous or identical wettability characteristics" means to make wettability characteristics of two or more different materials uniform (e.g., identical or normalized) and/or substantially identical (e.g., within a 5 percent tolerance). For example, a coating (e.g., a same or identical coating) can be provided to channels, paths, holes or slots of an over molded compound composed of a first material having a first wettability characteristic and a die composed of a second material having a second wettability characteristic different than the first wettability characteristic. In some examples, the die can include a third material having a third wettability characteristic. Thus, an example coating disclosed herein harmonizes (e.g., makes identical or near identical) the wettability characteristics of two or more materials defining a fluid flow path of a fluid ejection device. To harmonize the wettability characteristic of the fluid feed path formed of two or more different materials example printheads, substrates (e.g., over molded compound, dies, etc.) and/or fluid ejection devices disclosed herein employ a hafnium oxide coating formed along the fluid feed path. The wettability enhancement coating provides the fluid feed path with a uniform wettability characteristic that improves printing fluid flow, thereby improving pen performance.

Additionally, some advantages of using hafnium oxide coating for wettability instead of a protective coating for protecting the surfaces enables a smaller amount of hafnium oxide (e.g., an application of the hafnium oxide coating with a thinner thickness). For example, application of the hafnium oxide coating is relatively a slow process. For instance, hafnium oxide coating is applied to substrates using Atomic Layer Deposition (ALD), which is a thin film growth technique in which a substrate is exposed to alternate pulses of source precursors, with intermediate purge steps including an inert gas to evacuate any remaining precursor after reaction with the substrate surface. Thus, the thicker the layer, the longer the manufacturing time.

In some examples, a multilayer coating including a wettability enhancement layer and a protective layer can be applied to a substrate. In this manner, the protective layer prevents printing fluid from etching or damaging the substrate, while the wettability enhancement layer improves wettability characteristics of the substrate. For example, hafnium oxide can be employed to enhance wettability characteristics of the substrate and a different material coating (ALD $Al_2O_3$, ALD $SiO_2$, ALD Ta) can be employed to provide a protective coating to the substrate (EMC, Si, SU8). This enables a much thinner application of the hafnium oxide because the hafnium oxide is used to improve and harmonize wettability, not as a protective layer. The thickness of the hafnium oxide coating can be reduced from 200 Angstrom (e.g., when used as a protective layer) to between approximately 10 Angstrom and 50 Angstrom, significantly improving manufacturing time.

Examples disclosed herein can be used with printing systems or fluid ejection devices including, but not limited to, 2D printers, 3D printers and/or any other fluid ejection devices or applications for example in the field of pharmaceutics, forensics, laboratories and/or any other applications. Suitable fluids for 2D and 3D printing applications may include inks, agents and/or any there printing fluids.

FIG. 1 illustrates an example printing system 100 having an example pen assembly 102 (e.g., a cartridge or an inkjet pen) in accordance with teachings disclosed herein. The printing system 100 of the illustrated example is a drop-on-demand thermal bubble inkjet printing system. However, the examples disclosed herein can implement any other printing system, fluid deliver device(s) (e.g., valves, etc.) and/or any other fluid delivery system(s). The printing system 100 includes the pen assembly 102, a fluid supply assembly 104, a mounting assembly 106, a media transport assembly 108, an electronic controller 110, and a power supply or power supplies 112 that provide power to the various electrical components of the printing system 100.

The pen assembly 102 includes a fluid ejection device or printhead 114 that is fluidically connected to a printing fluid source 120 (e.g., a reservoir, a dispenser, a pipette, a continuous fluid source, etc.) of the fluid supply assembly 104 so as to receive printing fluid therefrom. As used herein, the term "printing fluid" refers to any fluid used in a printing process, including but not limited to inks, preconditioners, fixers, etc. The printhead 114 includes a plurality of fluid ejection devices 116 (e.g., nozzles) to eject printing fluid drops 122 onto a print medium 118, such as paper, card stock, transparencies, Mylar, and/or other media, positioned adjacent to the printhead 114. The fluid ejection devices 116 may be configured to eject printing fluid in any suitable manner. Examples include, but are not limited to, thermal fluid ejection mechanisms, piezoelectric fluid ejection mechanisms, etc. In some examples, the printhead 114 is arranged in column(s) or array(s) such that properly sequenced ejection of printing fluid (e.g., ink) from the fluid ejection devices 116 causes characters, symbols, and/or other graphics or images to be printed onto print medium 118 as the pen assembly 102 and the print medium 118 are moved relative to each other.

The fluid supply assembly 104 supplies printing fluid to the pen assembly 102. The printing fluid flows from the fluid source 120 to the pen assembly 102. The fluid supply assembly 104 and pen assembly 102 can form a one-way fluid delivery system or a recirculating fluid delivery system. In a one-way fluid delivery system, substantially all of the printing fluid supplied to pen assembly 102 is consumed during printing. In a recirculating fluid delivery system, however, only a portion of the printing fluid supplied to the pen assembly 102 is consumed during printing. Any printing fluid not consumed during printing is returned to the fluid supply assembly 104.

The fluid source 120 provides a supply of printing fluid and can have either an on-axis configuration or an off-axis configuration. In an on-axis configuration, the fluid source 120 is wholly contained onboard the pen assembly 102. For example, printhead 114 and the fluid supply assembly 104 are housed together in the pen assembly 102. With an off-axis configuration, the fluid supply assembly 104 is separate from the pen assembly 102 and supplies the printing fluid to pen assembly 102 through an interface connection, such as a supply tube or other conduit. For example, a relatively small reservoir located onboard the pen assembly 102 is fluidly coupled to an off-board reservoir (e.g., the fluid source 120). The onboard fluid reservoir is in fluid communication with the printhead 114. In either example, the fluid source 120 of the fluid supply assembly 104 may be removed, replaced, and/or refilled.

The mounting assembly 106 is configured to move the pen assembly 102 and the printhead 114 relative to the print medium 118. In one example, the mounting assembly 106 is a scanning carriage that traverses the printhead 114 back-and-forth across the print medium 118. The media transport assembly 108 is positioned relative to the mounting assembly 106 so as to define a print zone adjacent to the printhead 114. The media transport assembly 108 moves the print medium 118 through the print zone so that the printing fluid drops 122 ejected by the printhead 114 are directed onto the print medium 118.

The electronic controller 110 (e.g., a printer controller) includes a processor, firmware, and other printer electronics for communicating with and controlling the pen assembly 102, the mounting assembly 106, and the media transport assembly 108. The electronic controller 110 receives data 124 from a host system, such as a computer, and includes memory for temporarily storing data 124. In some examples, the data 124 is sent to the printing system 100 along an electronic, infrared, optical, or other information transfer path. The data represents, for example, a document and/or file to be printed. As such, the data 124 forms a print job for the printing system 100 and includes print job command(s) and/or command parameter(s). In response to the data, the electronic controller 110 provides control of the fluid ejection devices 116, including timing control for ejection of the printing fluid. The electronic controller 110 also controls the mounting assembly 106 and the media transport assembly 108 to provide the desired relative positioning of the printhead 114 and the print medium 118. Thus, the electronic controller 110 defines a pattern of the printing fluid drops 122 to be ejected from the printhead 114 that form characters, symbols, and/or other graphics or images on print medium 118.

While an example manner of implementing the printing system 100 is illustrated in FIG. 1, the elements, processes, and/or devices illustrated in FIG. 1 may be combined, divided, re-arranged, omitted, eliminated, and/or implemented in any other way. Further, the example pen assembly 102, the example fluid supply assembly 104, the example mounting assembly 106, the example media transport assembly 108, and the example electronic controller 110 and/or, more generally, the example printing system 100 of FIG. 1 may be implemented by hardware, software (machine readable instructions), firmware and/or any combination of hardware, software and/or firmware. Thus, for example, any of the example pen assembly 102, the example fluid supply assembly 104, the example mounting assembly 106, the example media transport assembly 108, and the example electronic controller 110 and/or, more generally, the example printing system 100 of FIG. 1 could be implemented by analog or digital circuit(s), logic circuit(s), programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example pen assembly 102, the example fluid supply assembly 104, the example mounting assembly 106, the example media transport assembly 108, and the example electronic controller 110 and/or, more generally, the example printing system 100 of FIG. 1 is/are hereby expressly defined to include a non-transitory computer readable storage device or storage disk such as a memory, a digital versatile disk (DVD), a compact disk (CD), a Blu-ray disk, etc. including the software and/or firmware. Further still, the example printing system 100 of FIG. 1 may include element(s), process(es) and/or device(s) in addition to, or instead of, those illustrated in FIG. 1, and/or may include more than one of any or all of the illustrated elements, processes and devices. As used herein, the phrase "in communication," including variations thereof, encompasses direct communication and/or indirect communication through intermediary component(s), and does not require direct physical (e.g., wired) communication and/or constant communication, but rather additionally includes selective communication at periodic intervals, scheduled intervals, aperiodic intervals, and/or one-time events.

Figure 2:
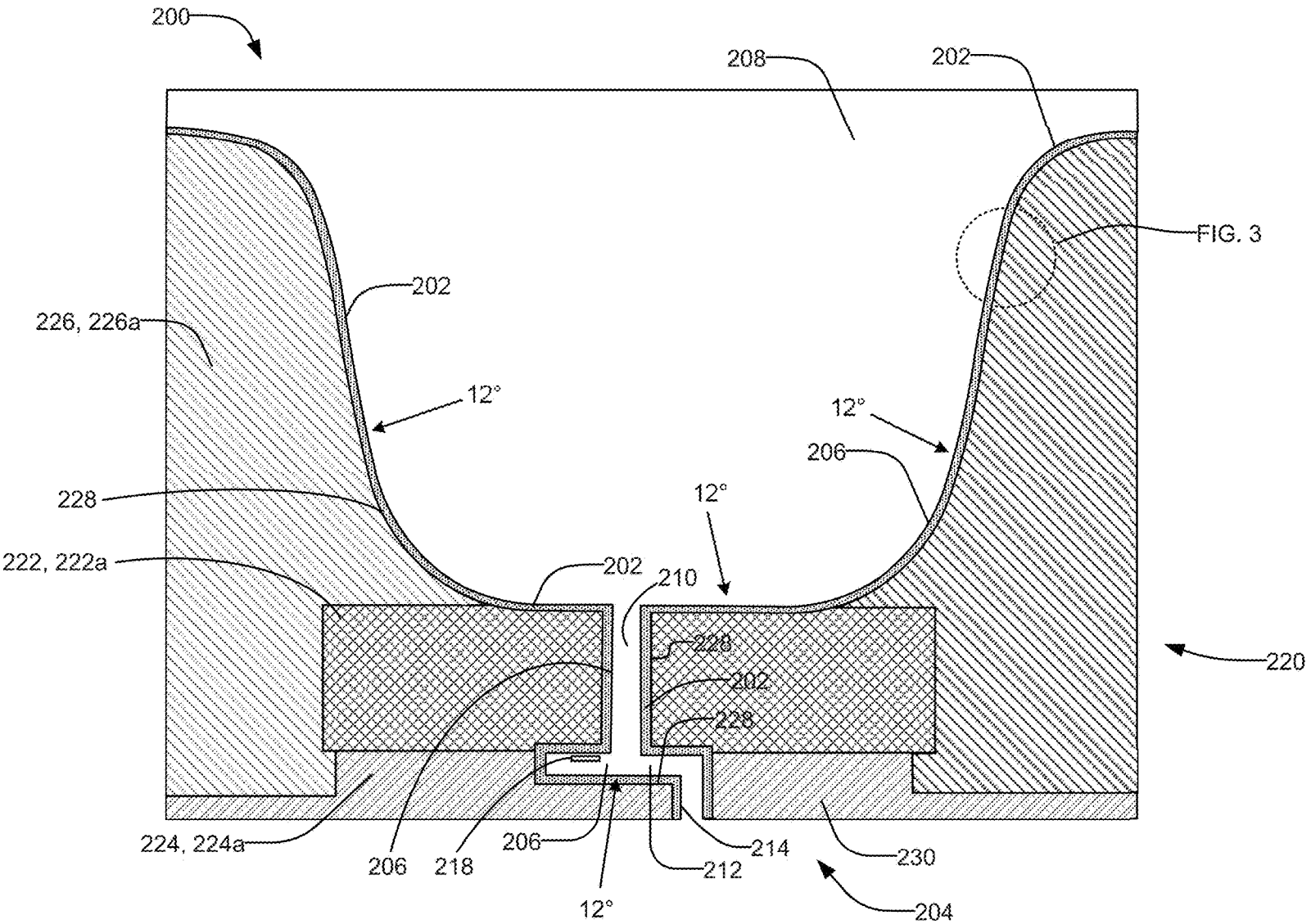
FIG. 2 is a schematic partial, cross-sectional view of an example printhead that can implement the example pen assembly of FIG. 1.

FIG. 2 is a side cross-sectional view of an example printhead 200 having a wettability enhancing coating 202 in accordance with teachings of this disclosure. The printhead 200 of the illustrated example can implement the printhead 114 and/or the pen assembly 102 of FIG. 1. The printhead 200 of the illustrated includes a substrate 204 (e.g., a substrate assembly) that defines a fluid feed path 206. In particular, the fluid feed path 206 is formed through the substrate 204. The fluid feed path 206 and/or the printhead 200 of the illustrated example includes a slot 208, a fluid feed hole 210, a firing chamber 212, and a nozzle 214. The slot 208 fluidically couples the fluid feed hole 210 to a fluid reservoir (e.g., the fluid source 120 of FIG. 1), and the fluid feed hole 210 fluidically couples the slot 208 and the firing chamber 212. The nozzle 214 is fluidically coupled to the firing chamber 212. A firing resistor 218 is formed in the firing chamber 212 and is connected to an electrical pad of a printed circuit board (PCB) via a lead. To print an image on a sheet of print media (e.g., the print medium 118), printing fluid flows from a fluid reservoir (e.g., the fluid source 120), through the slot 208, through the fluid feed hole 210, through the firing chamber 212 and exits through the nozzle 214. For example, in operation, an electrical signal is provided to the firing resistor 218 in the firing chamber 212 via the electronic controller 110, which provides heat to vaporize a portion of the printing fluid and form a bubble within the firing chamber 212. The bubble propels a print fluid drop (e.g., the printing fluid drops 122 of FIG. 1) through the nozzle 214 onto the print medium 118. The firing chamber 212 is then refilled by capillary action. In some examples, the PCB and/or the firing resistor 218 can be connected to a power source (e.g., the power source 112 of FIG. 1) and a controller (e.g., the electronic controller 110 of FIG. 1) such that the firing resistor 218 can be activated upon demand to cause ejection of a fluid droplet (e.g., the printing fluid drops 122 of FIG. 1) from the nozzle 214 and onto the print medium 118.

The printhead 200 of the illustrated example can be composed of different material(s). The printhead 200 of the illustrated example is a printhead die 220 composed of a support substrate 222 and a thin film layer 224 (e.g., a negative photoresist layer) In the illustrated example, the printed 200 includes a moldable carrier 226. However, in some examples, the printhead 200 does not include the moldable carrier 226. The support substrate 222 can be silicon (Si), glass, and/or any other substrate. The thin film layer 224 can include a negative photoresist layer or an epoxy-based negative photoresist material such as, for example, SU-8. The moldable carrier 226 can include, for example, an epoxy mold compound (EMC) including, but not limited to, at least one epoxide functional group, a self-cross linking epoxy, a polyepoxide that uses a co-reactant to cure the polyepoxide, a thermosetting polymer, and/or any other suitable material(s).

The printhead die 220 of the illustrated example includes a silicon (Si) substrate 222*a*, an SU-8 layer 224*a*, and an EMC substrate 226*a*. The EMC substrate 226*a* is overmolded with the silicon substrate 222*a* and the SU-8 layer 224*a*. Specifically, the fluid feed path 206 of the illustrated example is formed by the EMC substrate 226*a*, the silicon substrate 222*a*, and the SU-8 layer 224*a*. In particular, the EMC substrate 226*a* defines the slot 208, the silicon substrate 222*a* defines the fluid feed hole 210, and the SU-8 layer 224*a* defines the firing chamber 212 and the nozzle 214. Thus, the fluid feed path 206 is composed of various different materials (e.g., Si, SU-8, and EMC). In some examples, the printhead 200 can be configured without the moldable carrier 226

The example printhead 200 has a hydrophobic top orifice to prevent fluid puddle (e.g., ink puddle) and a hydrophilic fluid feed path to improve fluid refill and minimize bubble trapping. However, each of the different materials (the silicon substrate 222*a*, the SU-8 layer 224*a*, the EMC substrate 226*a*) has a different water contact angle, resulting in a fluid feed path 206 having different wettability characteristics. For example, the EMC substrate 226*a* has a contact angle of approximately 76 degrees (76°), the Si substrate 222*a* has a contact angle of approximately 25 degrees (25°), and the SU-8 layer 224*a* has a contact angle of approximately 62 degrees (62°). Further, substrate material(s) having a relatively high contact angle provide reduced wettability characteristic(s) that can affect print head performance. As a result, a frictional force on the surface of the walls defining the fluid feed path 206 can imped sufficient fluid flow through the fluid feed path 206 (i.e., along the slot 208, the fluid feed hole 210, the firing chamber 212 and/or the nozzle 214). The greater the water contact angle, the greater a friction force the material (e.g., the Si material, the SU-8 material, the EMC material) imparts to the printing fluid, thereby causing a slower moving printing fluid through the fluid feed path 206. In other words, the smaller the water contact angle, the greater the wettability characteristic. A greater wettability characteristic of the fluid feed path 206 improves operating performance of the printhead 200. For example, a greater wettability characteristic (e.g., a smaller water contact angle) increases a refill speed of the printing fluid in the firing chamber 212 and minimizes bubble trapping at the nozzle 214, the fluid feed hole 210, and/or the slot 208.

To harmonize and enhance the wettability characteristics of the fluid feed path 206, the printhead 200 of the illustrated example employs a wettability enhancement coating 202. The wettability enhancement coating 202 of the illustrated example is applied on the fluid feed path 206 from a fluid reservoir (e.g., the fluid source 120 of FIG. 1) to the nozzle 214. Specifically, the wettability enhancement coating 202 is provided on exposed walls or surfaces 228 of the substrate 204 and/or the printhead die 220 defining the fluid feed path 206. For example, the wettability enhancement coating 202 is provided on the EMC substrate 226*a* defining the slot 208, the silicon substrate 222*a* defining the fluid feed hole 210, and the SU-8 layer 224*a* defining the firing chamber 212 and the nozzle 214. Thus, surfaces 228 defining the slot 208, the fluid feed hole 210, the firing chamber 212, and the nozzle 214 include the wettability enhancing coating 202. The wettability enhancement coating 202 of the illustrated example is provided along an entire length of the fluid feed path 206 between the fluid source 120 (FIG. 1) and the nozzle 214. In some examples, however, the wettability enhancement coating 202 is provided on a portion of the fluid feed path 206 between the fluid source 120 and the nozzle 214. Additionally, to prevent fluid puddle at the nozzle 214 and, thus, improve ejection efficiency of the printing fluid from the nozzle 214, a top or outer surface 230 (e.g., an outer surface) of the SU-8 layer 224*a* does not include the wettability enhancement coating 202. Thus, the outer surface 230 defining the nozzle 214 has a hydrophobic characteristic.

The wettability enhancement coating 202 of the illustrated example harmonizes (e.g., makes uniform) the wettability characteristics of the fluid feed path 206. For example, the wettability enhancement coating 202 provides a uniform water contact angle along the fluid feed path 206 of the printhead die 220. The wettability enhancement coating 202 of the illustrated example significantly improves wettability characteristics of the printhead 200 regardless of the various materials defining the fluid feed path 206. For example, the wettability enhancement coating 202 provides a uniform water contact angle despite the EMC substrate 226*a*, the silicon substrate 222*a*, and the SU-8 layer 224*a* having different water contact angles. Thus, the wettability enhancement coating 202 harmonizes or makes uniform the surface wetting of various components of the fluid feed path of the printhead 200.

The wettability enhancement coating 202 of the illustrated example is hafnium oxide ($HfO_2$). For example, hafnium oxide has a water contact angle of approximately twelve degrees (12°). Thus, the fluid feed path 206 of the illustrated example has a water contact angle of approximately 12 degrees between the fluid source 120 and the nozzle 214. In contrast, as noted above, the water contact angle of EMC is approximately 76 degrees, the water contact angle of Si is approximately 25 degrees, and the water contact angle of SU-8 is approximately 62 degrees.

Figure 3:
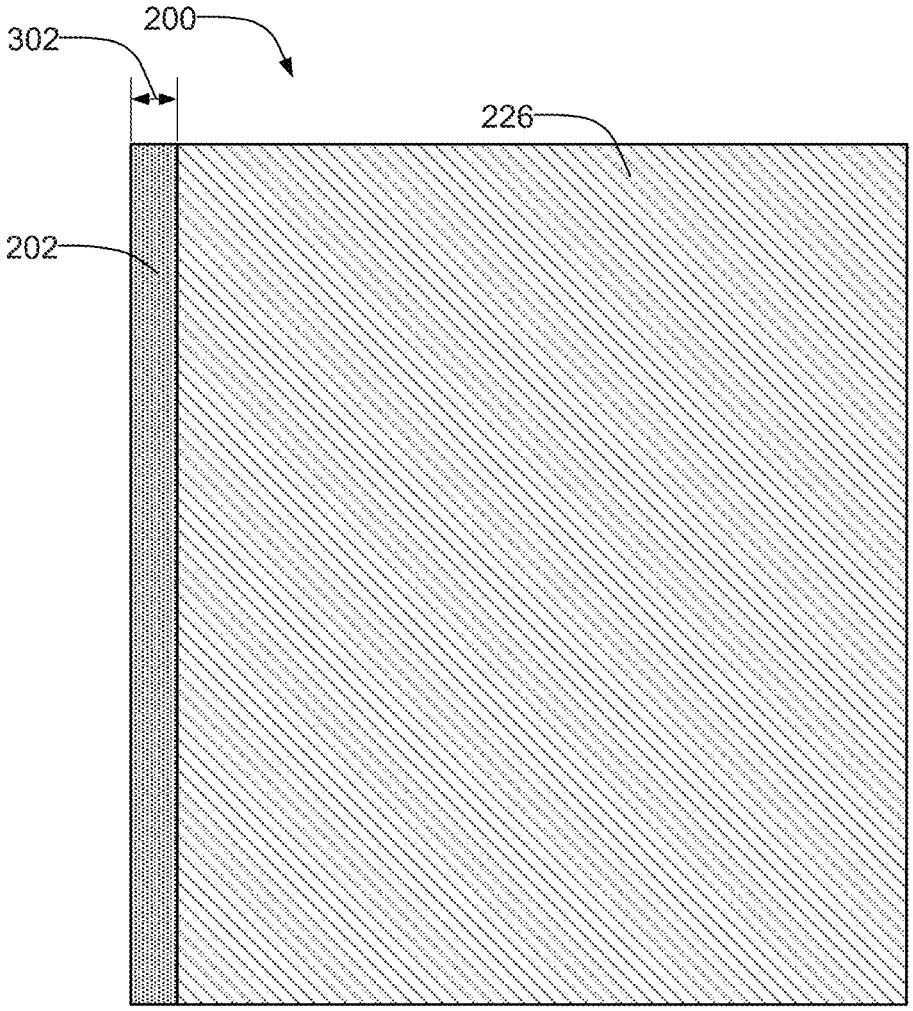
FIG. 3 is an enlarged view of the encircled portion of the example printhead of FIG. 2.

FIG. 3 is an enlarged view of the encircled portion of the printhead 200 of FIG. 2. The wettability enhancement coating 202 has a thickness 302. For example, the thickness of the wettability enhancement coating is approximately between 10 Angstroms and 100 Angstroms. As noted above, when the wettability enhancement coating 202 is employed as a protective coating, the thickness 302 is significantly greater than 100 Angstroms. For example, the wettability enhancement coating 202 could have a thickness greater than 250 Angstroms when used as a protective coating. Also, in some instances (e.g., when the wettability enhancement coating 202 is composed of hafnium oxide), application of the wettability enhancement coating 202 having a thickness greater than 100 Angstroms significantly increases manufacturing time, thereby decreasing manufacturing efficiency.

Figure 4:
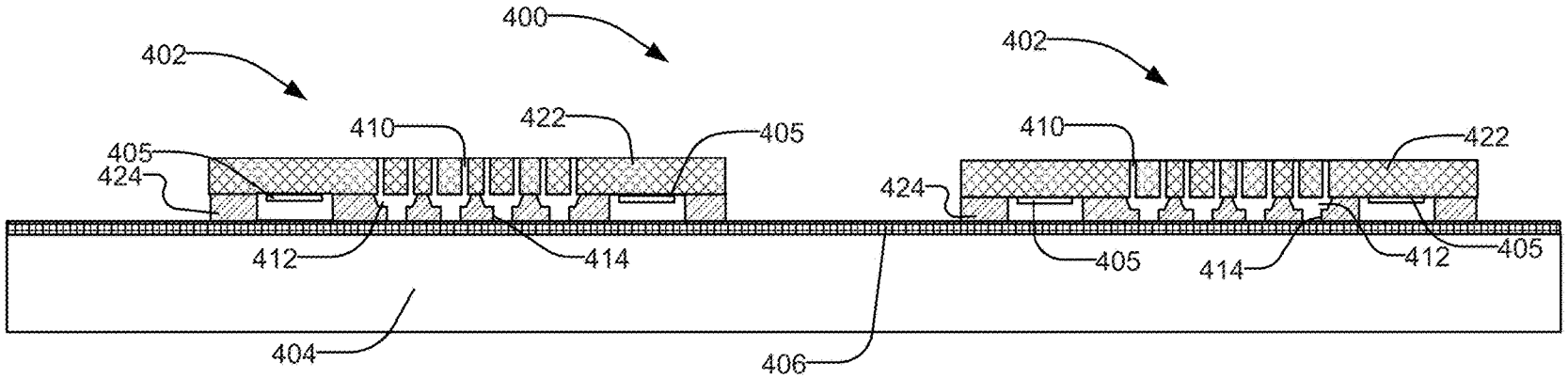
FIG. 4 is a side cross-sectional view of an example panel that includes an example plurality of printheads disclosed herein shown in a first manufacturing state.

FIG. 4 is a side cross-sectional view of a wafer or panel 400 having a plurality of printhead dies 402 disclosed herein shown in a first manufacturing stage. As shown in FIG. 4, the printhead dies 402 can implement the printhead 200 of FIG. 2 and/or the printhead 114 of FIG. 1. Although a "panel" is sometimes used to denote a rectangular substrate while a "wafer" is used to denote a circular substrate, a "panel" or "wafer" as used in this document includes any shape substrate. The printhead dies 402 are supported on and/or coupled to a carrier 404 via a thermal release tape 406 (e.g., adhesive). For example, the printhead dies of FIG. 4 include a support substrate 422 (e.g., a glass substrate, the silicon substrate 222*a*, etc.) and a negative photoresist layer 424 (e.g., the SU-8 layer 224*a*) layered on the support substrate 422. The support substrate 422 defines fluid feed holes 410 (e.g., the fluid feed hole 210), and the negative photoresist layer 424 defines firing chambers 412 (e.g., the firing chamber 212) and nozzles 414 (e.g., the nozzle 214) of the printhead dies 402. In some examples, a number of rows of nozzles 414 and their respective corresponding circuitry and resistive heating elements may be included within the printhead dies 402. Thus, a single row of nozzles and their respective corresponding circuitry and resistive heating elements define respective ones of the printhead dies 402. The printhead dies 402 may include a connection pad or multiple connection pads 405 to electrically couple the printhead dies 402 to a controller of a printing system (e.g., the printing system 100). The printhead dies 402 can be coupled to a printed circuit board (PCB).

The printhead dies 402 are manufactured from selected combinations of thin film layers of material that are deposited or grown on substrates using processes adapted from semiconductor component fabrication and microelectrical mechanical systems (MEMS) manufacturing technique(s) or processes. For example, each of the negative photoresist layer 424 and/or the support substrate 422 can be manufactured or formed via photolithography, etching, and/or any other suitable processes. The support substrate 422 can be etched to form the fluid feed holes 410. To form the firing chambers 412 and the nozzles 414, portions of the negative photoresist layer 424 that are exposed to ultra-violet (UV) radiation become cross-linked, while the remainder of the film or layer remains soluble and can be washed away during development. The negative photoresist layer 424 is coupled to the support substrate 422 such that the fluid feed holes 410 are fluidically coupled to the firing chambers 412 and the nozzles 414. The negative photoresist layer 424 and the support substrate 422 surround or encase connection pads 405, or other electrical connections, and a wafer thinning process is employed to reduce a thickness 403 of the support substrate 422 to a target thickness. For example, the support substrate 422 can have a thickness 403 of approximately 650 micrometers. Wafer thinning is the process of removing material from the backside of a wafer to a desired final target thickness. Two example methods of wafer thinning include grind and chemical-mechanical planarization (CMP)

Figure 5:
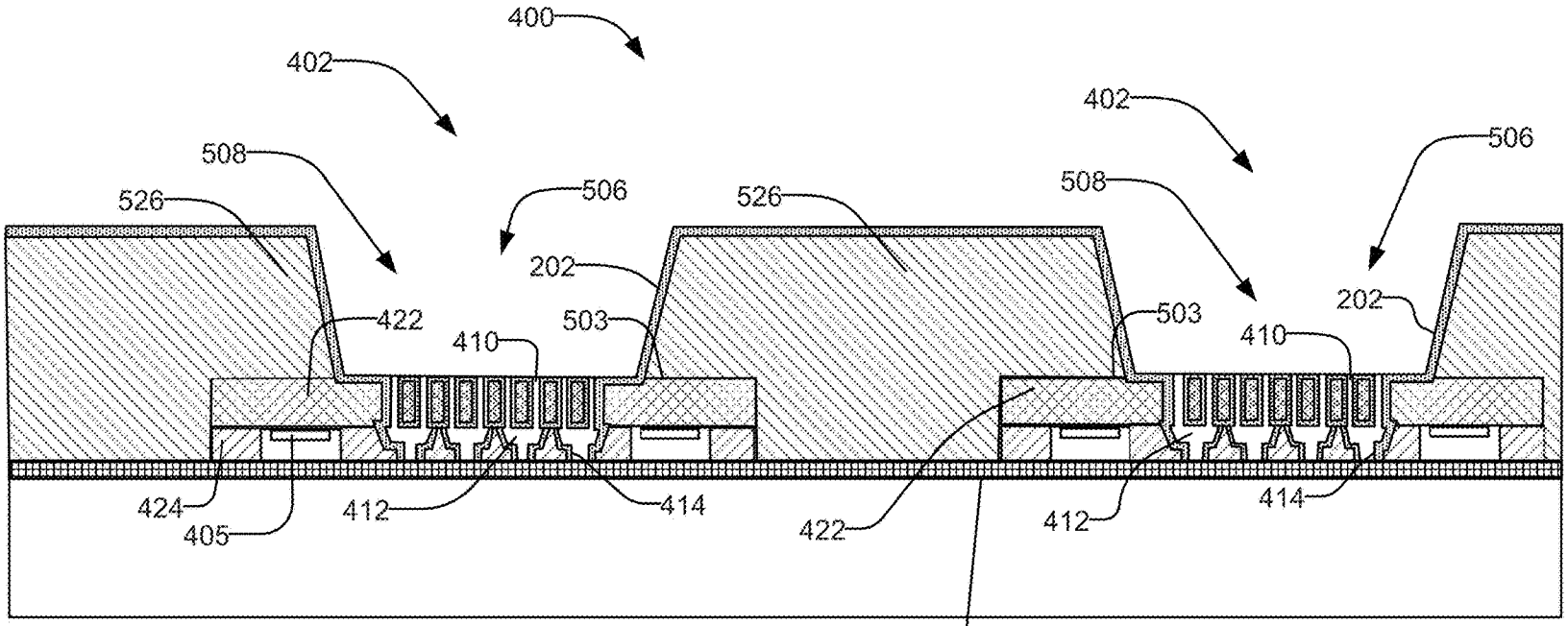
FIG. 5 is a side cross-sectional view of the example panel of FIG. 4 shown in a second manufacturing state.

FIG. 5 is a side cross-sectional view of the example panel 400 of FIG. 4 shown in a second manufacturing stage. Specifically, the panel 400 of FIG. 5 includes a moldable substrate 526 (e.g., the moldable carrier 226 or the EMC substrate 226*a*) and the wettability enhancement coating 202. The moldable substrate 526 defines slots 508 (e.g., the slot 208) of the printhead dies 402 that are fluidically coupled to the fluid feed holes 410. The panel 400 of FIG. 5 illustrates the support substrate 422 and the negative photoresist layer 424 over-molded with moldable substrate 526. After the moldable substrate 526 is overmolded with the support substrate 422 and the negative photoresist layer 424, the wettability enhancement coating 202 is applied to the printhead dies 402. For example, the wettability enhancement coating 202 can be applied after wafer thinning process and/or molding of the moldable substrate 526, but prior to release for electric pad (e.g., a gold (Au) pad) protection. As noted above, the wettability enhancement coating 202 is applied via the ALD manufacturing process.

The wettability enhancement coating 202 is applied on an entire length of a fluid feed path 506 between a reservoir (e.g., the fluid source 120) and the nozzles 414. For example, the wettability enhancement coating 202 is applied to the fluid feed path 506 defined by the slots 508, the fluid feed holes 410, the firing chambers 412 and the nozzles 414. Specifically, the wettability enhancement coating 202 is applied to surfaces of the support substrate 422 defining the fluid feed holes 410, surfaces of the negative photoresist layer 424 defining the firing chambers 412 and the nozzles 414, and surfaces of the moldable substrate 526 defining the slots 508. Thus, in this example, the wettability enhancement coating 202 is provided everywhere in the fluid feed path 506 including exposed silicon backside die surfaces 503 and the slots 508. Each of the printhead dies 402 on the panel 400 can be processed to produce a single printhead (e.g., the printhead 200 or the printhead 114). For example, after fabrication, the printhead dies 402 can be separated and incorporated into print cartridges or carriers (e.g., the pen assembly 102 of FIG. 1) that connect the printhead with a fluid supply (e.g., the fluid source 120).

FIGS. 6-14 illustrate additional example printheads or printhead dies 600, 702, 900, 1102, and 1202 disclosed herein. Those components of the example printheads or printhead dies 600, 702, 900, 1102, and 1202 that are substantially similar or identical to the components of the example printheads 200 and 402 disclosed above in connection with FIGS. 1-5 and that have functions substantially similar or identical to the functions of those components will not be described in detail again below. Instead, the interested reader is referred to the above corresponding descriptions. To facilitate this process, similar reference numbers will be used for like structures.

Figure 6:
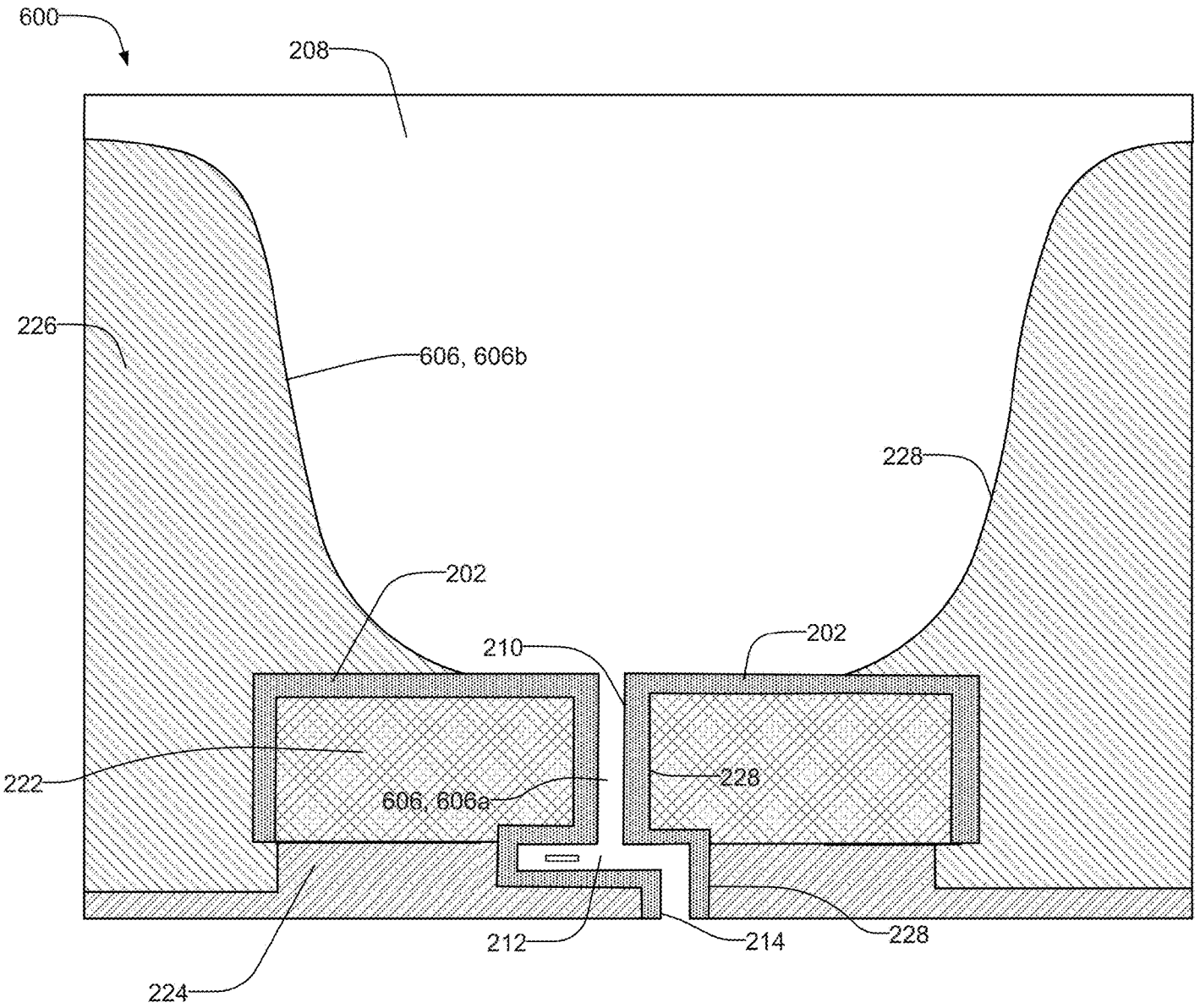
FIG. 6 is a schematic partial, cross-sectional view of another example printhead disclosed herein.

FIG. 6 illustrates a printhead 600 that includes a fluid feed path 606 that is substantially similar to the fluid feed path 206 of FIG. 2. However, the fluid feed path 606 includes a wettability enhancement coating 202 on a first portion 606*a* of the fluid feed path 606, and the fluid feed path 606 does not include the wettability enhancement coating 202 on a second portion 606*b* of the fluid feed path 606. For example, the wettability enhancement coating 202 is provided on surfaces 228 defining a fluid feed hole 210 (e.g., defined by the support substrate 222), a firing chamber 212, and a nozzle 214 (e.g., defined by the thin film layer 224). Thus, surfaces 228 (e.g., the EMC substrate 226*a*) defining the slot 208 do not include the wettability enhancement coating 202. In other words, the wettability enhancement coating 202 of the illustrated example is applied only on the support substrate 222 and the thin film layer 224, and the wettability enhancement coating 202 is not applied on the moldable carrier 226. In some examples, the moldable substrate is not provided and/or the slot 208 is defined by the support substrate 222.

Figure 7:
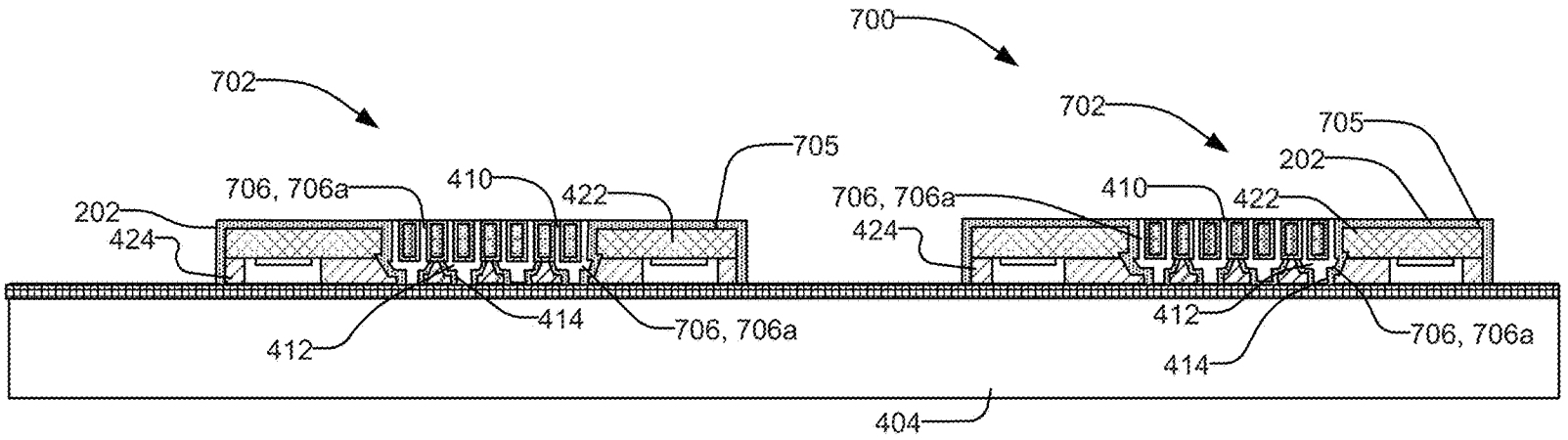
FIG. 7 is a side cross-sectional view of another example panel that includes another example plurality of printheads disclosed herein shown in a first manufacturing state.

FIG. 7 is a side cross-sectional view of a panel 700 disclosed herein including a plurality of printhead dies 702 disclosed herein. The printhead dies 702 can implement the printhead 600 of FIG. 6. The printhead dies 702 are supported on a carrier 404. In this example, the printhead dies 702 are attached to the carrier 404 via a thermal release tape 406 (e.g., adhesive). The printhead dies 702 are substantially similar to the printhead dies 402 of FIGS. 4 and 5. For example, the negative photoresist layer 424 and the support substrate 422 define or form the fluid feed holes 410, the firing chambers 412, and the nozzles 414. However, a wettability enhancement coating 202 is applied to a first portion 706*a* (e.g., a partial portion) of a fluid feed path 706. Thus, the wettability enhancement coating 202 is applied on a backside surface 705 of the support substrate 222, the fluid feed hole 410 of the support substrate 222, and surfaces defining of the firing chambers 412 and the nozzles 414. After formation of the support substrates 422 and the negative photoresist layers 424 of the printhead dies 702 via semiconductor manufacturing technique(s) and process(es), the wettability enhancement coating 202 is applied via the ALD process. In the illustrated example, the wettability enhancement coating 202 is applied after wafer thinning.

Figure 8:
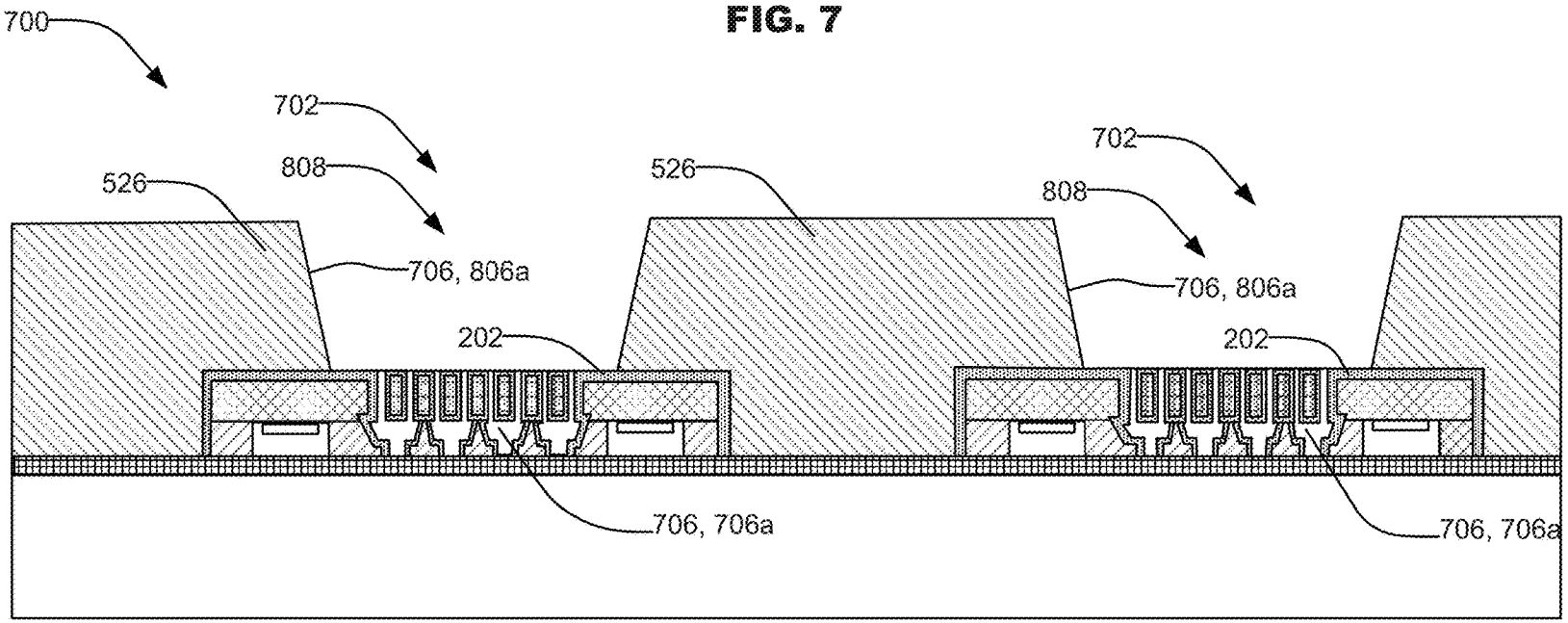
FIG. 8 is a side cross-sectional view of the example panel of FIG. 7 shown in a second manufacturing state.

FIG. 8 is a side cross-sectional view of the example panel 700 of FIG. 7. After the wettability enhancement coating 202 is applied to the support substrate 422 and the negative photoresist layer 424, the moldable substrate 526 is overmolded with the support substrate 422 and the negative photoresist layer 424. The wettability enhancement coating 202 is not provided on surfaces of the moldable substrate 526 defining a slot 808 fluidically coupled to the fluid feed holes 410. In the illustrated example, the wettability enhancement coating 202 is applied prior to overholding the support substrate 422 and the negative photoresist layer 424 with the moldable substrate 526. Thus, a second portion 806*a* of the fluid feed path 706 is not coated with the wettability enhancement coating 202.

Figure 9:
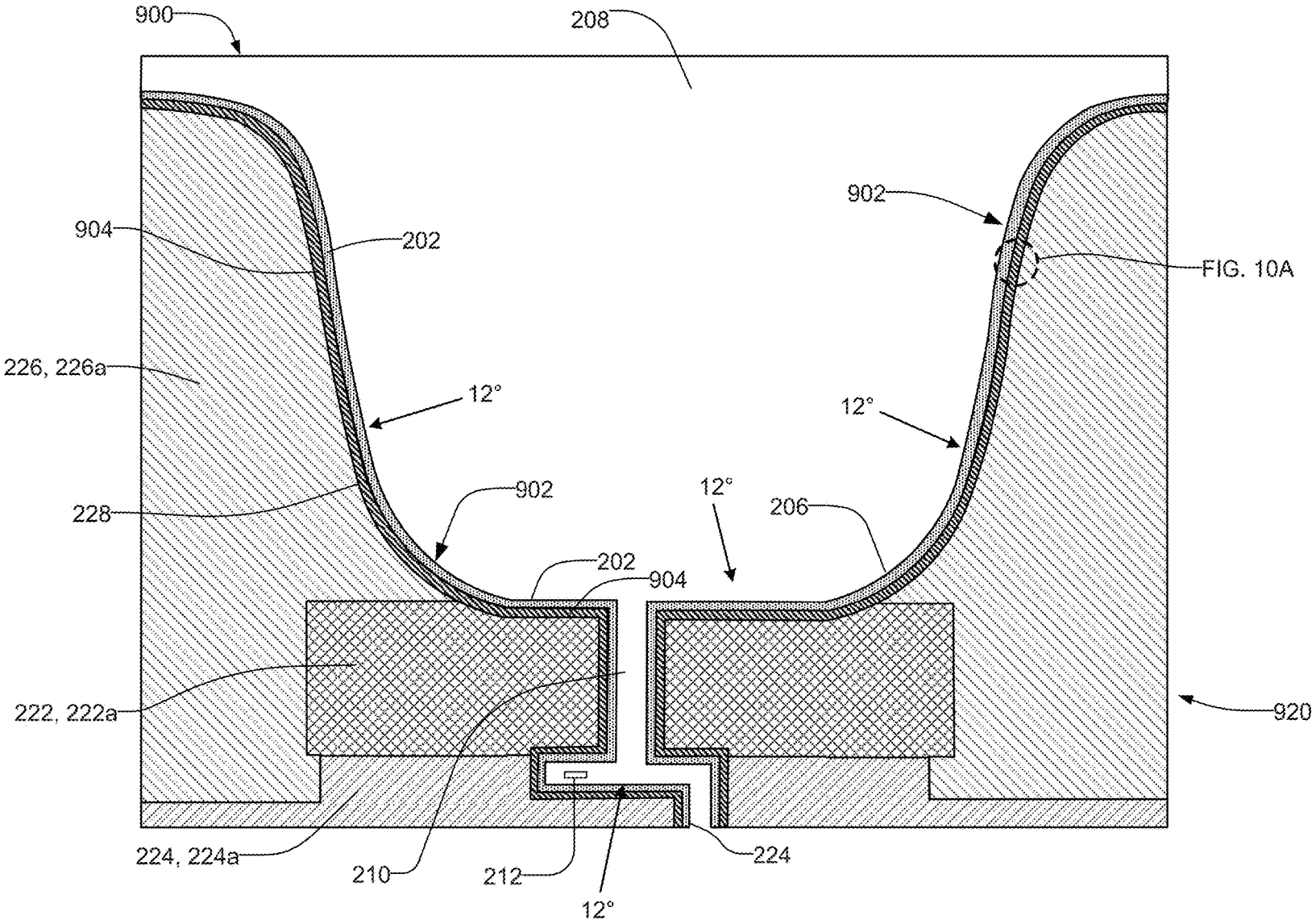
FIG. 9 is a schematic partial, cross-sectional view of another example printhead disclosed herein.

FIG. 9 illustrates another example printhead 900 disclosed herein. The example printhead 900 can implement the example printhead 114 of FIG. 1. The printhead 900 includes a multilayer coating 902 (e.g., a film stack). The printhead 900 includes a printhead die 920 defining a fluid feed path 206 that includes a slot 208, a fluid feed hole 210, a firing chamber 212, and a nozzle 214. For example, a support substrate 222 (e.g., silicon substrate 222*a*), a thin film layer 224 (e.g., a negative photoresist layer, an SU-8 layer 224*a*), and a moldable carrier 226 (e.g., an EMC substrate 226*a*) define the printhead die 920.

The multilayer coating 902 of the illustrated example includes a protective coating 904 and a wettability enhancement coating 202. Specifically, the multilayer coating 902 can be applied on surfaces 228 of the printhead die 920 defining the fluid feed path 206. In the illustrated example, the multilayer coating 902 is formed along an entire length of the fluid feed path 206 between a fluid source 120 and the nozzle 214. Thus, the multilayer coating 902 is applied to surfaces defining the slot 208, the fluid feed hole 210, the firing chamber 212, and the nozzle 214. However, in some examples, the multilayer coating 902 can be formed on a portion (e.g., the first portion 606*a*, 706*a*) of a fluid feed path (e.g., the fluid feed path 606, 706) between the fluid source 120 and the nozzle 214. For example, the multilayer coating 902 can be applied on surfaces defining the fluid feed hole 210, the firing chamber 212, and the nozzle 214. In other words, surfaces defining the slot 208 do not include the multilayer coating 902. The protective coating 904 is positioned between materials defining the printhead die 920 (e.g., the support substrate 222, the negative photoresist layer 224, the moldable carrier 226) and the wettability enhancement coating 202. In some examples, the protective coating 904 can be composed of silicon dioxide ($SiO_2$), silicon nitride ($Si_3N_4$), aluminum oxide ($Al_2O_3$), tantalum. silicon carbide, and/or any other printing fluid impervious material(s).

The protective coating 904 provide a printing fluid impervious layer that protects the printhead die from printing fluid attack (e.g., etching). For example, the printing fluid can be a pigmented ink. The use of pigmented inks often provides greater color gamut, high fad resistance, better water-fastness, shorter dry time, and great media compatibility when compared to dye-based inks. However, pigmented inks include charged dispersants and pigment particles or high pH solvent that may etch the materials of the printhead 900 (e.g., the silicon, the SU-8, the EMC, etc.). The multilayer coating 902 via the protective coating 904 prevents the printing fluid from etching materials of the printhead die 920 (e.g., the silicon substrate 222*a*). In other words, the wettability enhancement coating 202 does not provide protection to ink attack but improves or enhances wettability characteristics. The protective coating 904 enables the wettability enhancement coating 202 to have a thickness 1002 that is less than 100 Angstroms.

Figures 10, 10A, 10B, 10C:
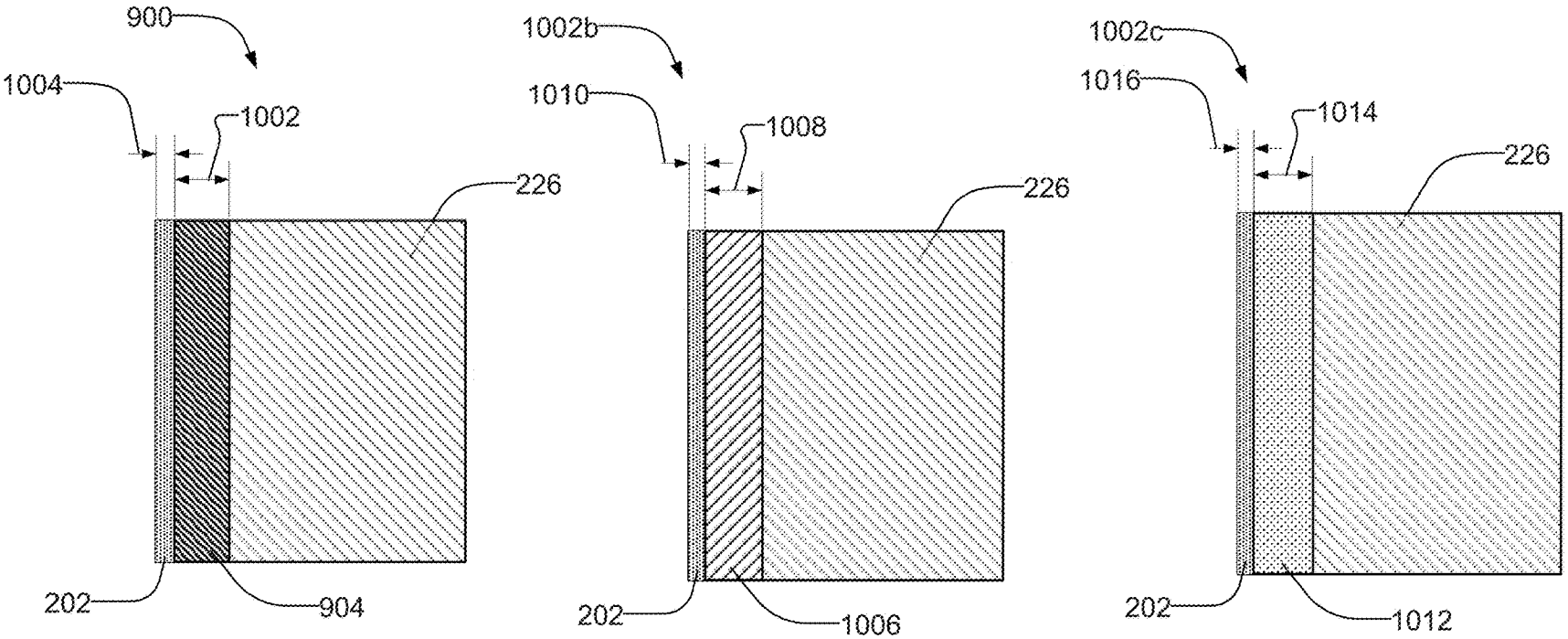
FIG. 10A is an enlarged view of the encircled portion of example printhead of FIG. 9.
FIGS. 10B-10C are enlarged views of example multilayer coatings that can implement the example printhead of FIG. 9.

FIG. 10A is an enlarged view of the encircled portion of the multilayer coating 902 of FIG. 9. The protective coating 904 of the printhead die 920 of FIG. 10A is aluminum oxide ($Al_2O_3$), and the wettability enhancement coating 202 is hafnium oxide. In some examples, the protective coating 904 has a thickness 1002 of approximately 0.3 micrometers, and the wettability enhancement coating 202 has a thickness 1004 of approximately 50 Angstroms. Both the protective coating 904 and the wettability enhancement coating 202 are provided on the printhead die via the ALD process.

As noted above, when the wettability enhancement coating 202 is composed of hafnium oxide and is employed as a protective coating, the thickness 1004 is significantly greater than 100 Angstroms (e.g., greater than 250 Angstroms), but this significantly increases manufacturing time and/or decreases manufacturing efficiency. In the illustrated example, the protective coating 904 enables a relatively small amount of hafnium oxide (e.g., less than 100 Angstrom) to be applied as the wettability enhancement coating 202, which provides enhanced wettability characteristics and also improves manufacturing efficiency.

FIG. 10B illustrates another example multilayer coating 1002*b* that can implement the printhead 900 of FIG. 9. The multilayer coating 1002*b* includes a protective coating 1006 and a wettability enhancement coating 202. In this example, the protective coating 1006 is silicon dioxide, and the wettability enhancement coating 202 is hafnium oxide. In some examples, the protective coating 1006 of FIG. 3C has a thickness 1008 of approximately 0.2 micrometers, and the wettability enhancement coating 202 has a thickness 1010 of approximately 100 angstroms. The silicon dioxide can be provided on a printhead die (e.g., the printhead die 220, 920, etc.) via plasma enhanced chemical vapor deposition (PECVD), inductively coupled plasma chemical vapor deposition (ICP CVD), microwave plasma assisted chemical vapor deposition (CVD), and/or any other manufacturing process(es). The wettability enhancement coating 202 is provided via the ALD process.

FIG. 10C illustrates another example multilayer coating 1002*c* that can implement the printhead 900 of FIG. 9. In this example, the multilayer coating 1002*c* includes a protective coating 1012 composed of Tantalum (Ta), and a wettability enhancement coating 202 composed of hafnium oxide. In some examples, the protective coating 1012 has a thickness 1014 of approximately 0.5 micrometers, and the wettability enhancement coating 202 has a thickness 1016 of approximately 20 Angstroms.

Figure 11:
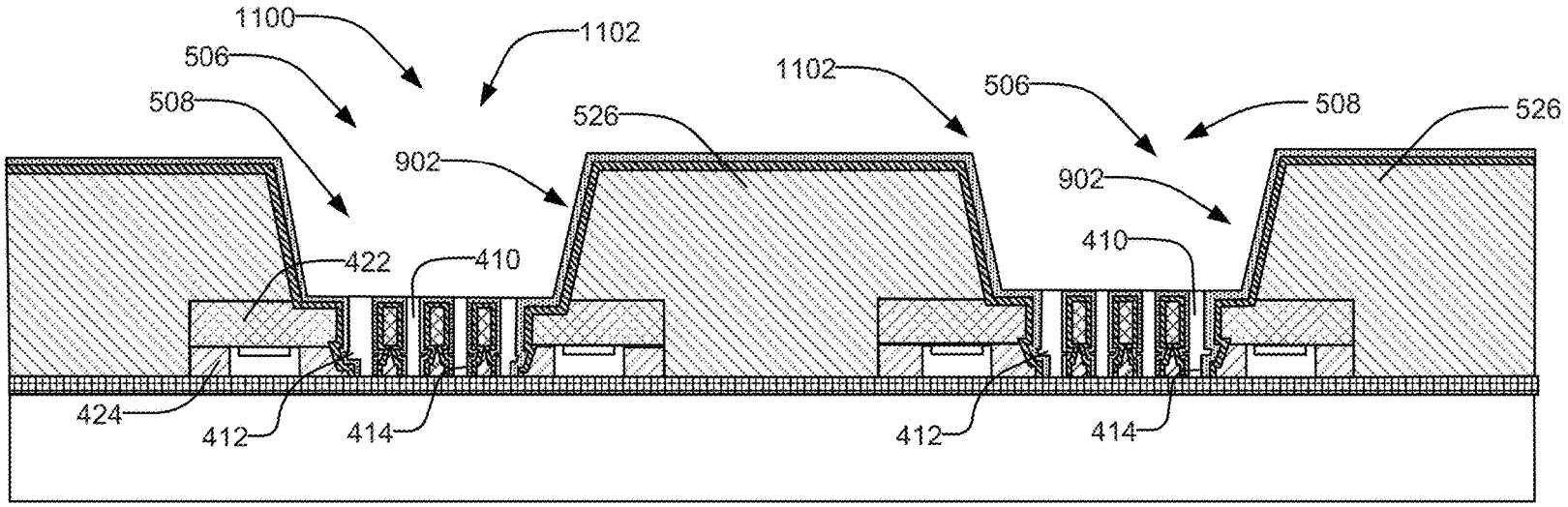
FIG. 11 is a side cross-sectional view of another example panel having another example plurality of printheads disclosed herein.

FIG. 11 is a side cross-sectional view of a panel 1100 disclosed herein including a plurality of printhead dies 1102 disclosed herein. The printhead dies 1102 are substantially similar to the printhead dies 402 of FIGS. 4 and 5. However, the printhead dies 1102 include the multilayer coating 902. The multilayer coating 902 is applied to the fluid feed path 506 including the slots 508, the fluid feed holes 410, the firing chambers 412, and the nozzles 414 (e.g., an entire length of the fluid feed path 506 between the fluid source 120 and the nozzles 414). The multilayer coating 902 is applied after molding the moldable carrier 226.

Figure 12:
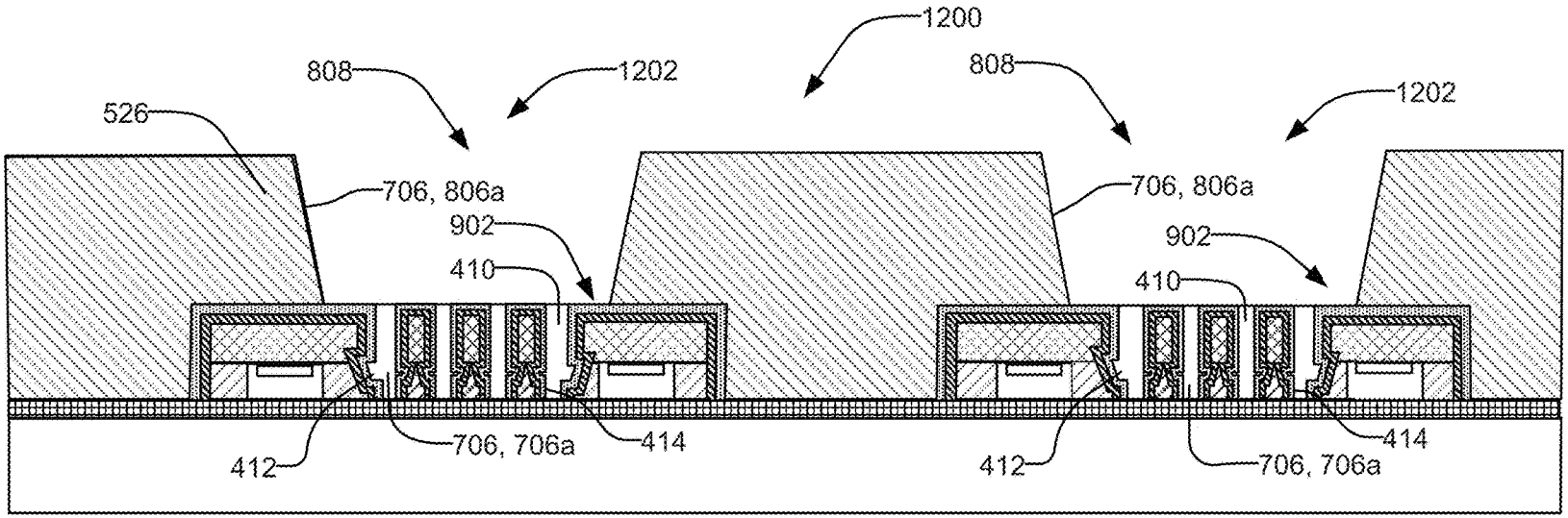
FIG. 12 is a side cross-sectional view of another example panel having yet another example plurality of printheads disclosed herein.

FIG. 12 is a side cross-sectional view of a panel 1200 disclosed herein including a plurality of printhead dies 1202 disclosed herein. The printhead dies 1202 are substantially similar to the printhead dies 702 of FIGS. 7 and 8. However, the printhead dies 1202 include the multilayer coating 902. Specifically, the multilayer coating 902 is applied to a first portion 706*a* of a fluid feed path 706 and is not applied to a second portion 806*a* (e.g., the slot 808) of the fluid feed path 706. Thus, the multilayer coating 902 is applied to surfaces defining the fluid feed holes 410, the firing chambers 412, and the nozzles 414. However, the multilayer coating 902 is not applied to surfaces defining the slot 808. In this example, the multilayer coating 902 is applied after wafer thinning and prior to molding the moldable substrate 526.

Figure 13:
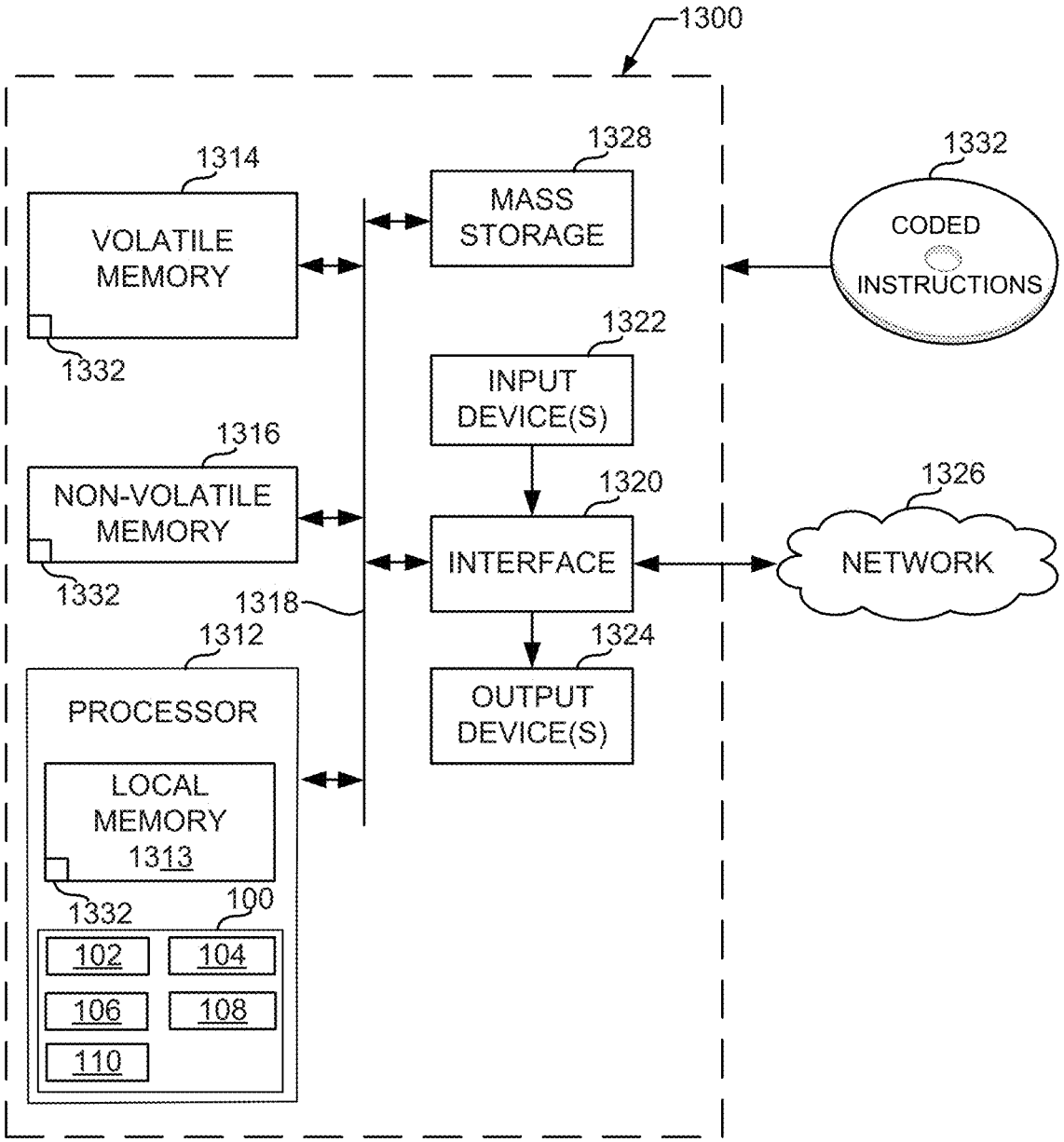
FIG. 13 is a block diagram of an example processing platform structured to execute instructions to implement the example printing system of FIG. 1.

FIG. 13 is a block diagram of an example processor platform 1300 structured to execute the instructions to implement the example pen assembly 102, the example fluid supply assembly 104, the example mounting assembly 106, the example media transport assembly 108, and the example electronic controller 110 and/or, more generally, the example printing system 100 of FIG. 1. The processor platform 1300 can be, for example, a server, a personal computer, a workstation, a self-learning machine (e.g., a neural network), a mobile device (e.g., a cell phone, a smart phone, a tablet), a personal digital assistant (PDA), an Internet appliance, or any other type of computing device.

The processor platform 1300 of the illustrated example includes a processor 1312. The processor 1312 of the illustrated example is hardware. For example, the processor 1312 can be implemented by integrated circuit(s), logic circuit(s), microprocessor(s), GPU(s), DSP(s), or controller (s) from any desired family or manufacturer. The hardware processor may be a semiconductor based (e.g., silicon based) device. In this example, the processor implements aspect(s) of the example pen assembly 102, the example fluid supply assembly 104, the example mounting assembly 106, the example media transport assembly 108, and the example electronic controller 110 and/or, more generally, the example printing system 100 of FIG. 1.

The processor 1312 of the illustrated example includes a local memory 1313 (e.g., a cache). The processor 1312 of the illustrated example is in communication with a main memory including a volatile memory 1314 and a non-volatile memory 1316 via a bus 1318. The volatile memory 1314 may be implemented by Synchronous Dynamic Random Access Memory (SDRAM), Dynamic Random Access Memory (DRAM), RAMBUS® Dynamic Random Access Memory (RDRAM®), and/or any other type of random access memory device. The non-volatile memory 1316 may be implemented by flash memory and/or any other desired type of memory device. Access to the main memory 1314, 1316 is controlled by a memory controller.

The processor platform 1300 of the illustrated example also includes an interface circuit 1320. The interface circuit 1320 may be implemented by any type of interface standard, such as an Ethernet interface, a universal serial bus (USB), a Bluetooth® interface, a near field communication (NFC) interface, and/or a PCI express interface.

In the illustrated example, input device(s) 1322 are connected to the interface circuit 1320. The input device(s) 1322 perm it(s) a user to enter data and/or commands into the processor 1312. The input device(s) can be implemented by, for example, an audio sensor, a microphone, a camera (still or video), a keyboard, a button, a mouse, a touchscreen, a track-pad, a trackball, isopoint, and/or a voice recognition system.

Output device(s) 1324 are also connected to the interface circuit 1320 of the illustrated example. The output devices 1324 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer, and/or speaker. The interface circuit 1320 of the illustrated example, thus, includes a graphics driver card, a graphics driver chip and/or a graphics driver processor.

The interface circuit 1320 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1326. The communication can be via, for example, an Ethernet connection, a digital subscriber line (DSL) connection, a telephone line connection, a coaxial cable system, a satellite system, a line-of-site wireless system, a cellular telephone system, etc.

The processor platform 1300 of the illustrated example also includes mass storage device(s) 1328 for storing software (e.g., machine readable instructions) and/or data. Examples of such mass storage devices 1328 include floppy disk drives, hard drive disks, compact disk drives, Blu-ray disk drives, redundant array of independent disks (RAID) systems, and digital versatile disk (DVD) drives.

The machine executable instructions 1332 may be stored in the mass storage device 1328, in the volatile memory 1314, in the non-volatile memory 1316, and/or on a removable non-transitory computer readable storage medium such as a CD or DVD.

The example methods, apparatus, systems, and articles of manufacture disclosed herein provide enhanced wettability characteristics for printheads and/or other fluid delivery systems to improve fluid delivery performance by reducing surface frictions of surfaces defining the fluid flow paths. In some examples, a fluid flow path is coated with hafnium oxide to enhance and harmonize wettability characteristics of the fluid flow path. To protect against ink attach or etching, fluid flow paths can be coated with a multilayer coating that includes a first coating to provide a protective barrier or layer composed of an ink impervious material and a second coating to enhance wettability characteristics.

At least some of the aforementioned examples include at least one feature and/or benefit including, but not limited to, the following:

In some examples, a printhead includes a nozzle to expel fluid therefrom, and a fluid feed path to fluidly couple a fluid source and the nozzle. Fluid feed path walls are composed of a first material having a first wettability characteristic and a second material having a second wettability characteristic. The second wettability characteristic differs from the first wettability characteristic. A coating is formed on at least a portion of the fluid feed path walls defined by the first material and the second material. The coating is to harmonize the first wettability characteristic and the second wettability characteristic.

In some examples, the fluid feed path includes a slot to receive fluid from the fluid source, and a fluid feed hole to enable fluid flow from the slot to a firing chamber upstream from the nozzle.

In some examples, the printhead includes a molded compound and a die, wherein the fluid feed path is formed through the compound and die, the molded compound including the first material and the die includes the second material In some examples, the coating is positioned on at least portions of the molded compound and the die defining the fluid feed path.

In some examples, the wettability coating includes hafnium oxide.

In some examples, wherein the coating includes a multilayer coating including a first layer composed of a third material to harmonize the first wettability characteristic and the second wettability characteristic, and a fourth material to protect the at least one of the first material or the second material.

In some examples, the first layer has a first thickness and the second layer has a second thickness, the second thickness being at least three times greater than the first thickness.

In some examples, the first thickness is between approximately 20 Angstroms and 100 Angstroms and the second thickness is between approximately 0.2 micrometers and 0.5 micrometers.

In some examples, the first layer includes hafnium oxide and the second layer includes an ink impervious material.

In some examples, the second layer includes at least one of aluminum oxide, silicon dioxide, or tantalum.

In some examples, the first material or the second material includes at least one of silicon, SU-8, or Epoxy Molding Compound (EMC).

In some examples, a fluid ejection device includes a substrate defining an ink feed path and a protective coating provided on the substrate defining the ink feed path to protect the ink feed path from ink attack. The protective coating having a first thickness. A hafnium oxide coating is provided on the protective coating along the ink feed path to change a wettability characteristic of the ink feed path. The hafnium oxide coating has a second thickness that is less than the first thickness.

In some examples, the protective coating includes at least one of aluminum oxide, silicon dioxide or tantalum.

In some examples, the protective coating is provided between the substrate and the hafnium oxide coating.

In some examples, the first thickness is approximately between 150 and 250 Angstrom, and the second thickness is approximately 50 Angstrom.

In some examples, a printhead includes a substrate defining a nozzle to expel fluid therefrom, and a fluid feed path to fluidly couple a fluid reservoir and the nozzle. A wettability coating is formed on at least a portion of the fluid feed path. The wettability coating is less than 100 Angstrom.

In some examples, the substrate includes a first layer composed of SU-8 defining a firing chamber fluidically coupling the nozzle and the fluid feed path, a second layer composed of silicon defining a fluid feedhole to fluidically couple a slot in fluid communication with the reservoir and the firing chamber, and a third layer composed of Epoxy Molding Compound (EMC) defining the slot.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A printhead comprising:

a substrate assembly to define a fluid feed path to fluidly couple a nozzle of the printhead and a fluid source, the substrate assembly including:

a first substrate defining the nozzle to expel fluid therefrom; the first substrate having a first wall defining a first portion of the fluid feed path, the first substrate composed of a first material having a first wettability characteristic; and a second substrate coupled to the first substrate, the second substrate having a second wall defining a second portion of the fluid feed path, the second substrate composed of a second material having a second wettability characteristic different from the first wettability characteristic; and a coating provided on at least the first wall of the first substrate and the second wall of the second substrate defining of the fluid feed path, the coating to harmonize the first wettability characteristic and the second wettability characteristic.

2. The printhead of claim 1, wherein the fluid feed path includes a slot to receive fluid from the fluid source, and a fluid feed hole to enable fluid flow from the slot to a firing chamber upstream from the nozzle.

3. The printhead of claim 1, wherein the substrate assembly includes a molded compound and a die, wherein the fluid feed path is formed through the compound and the die, the molded compound including the first material and the die includes the second material.

4. The printhead of claim 3, wherein the coating is positioned on at least portions of the molded compound and the die defining the fluid feed path.

5. The printhead of claim 1, wherein the coating includes hafnium oxide.

6. The printhead of claim 1, wherein the coating includes a multilayer coating having a first layer composed of a third material to harmonize the first wettability characteristic and the second wettability characteristic, and a second layer composed of a fourth material to protect at least one of the first material or the second material.

7. The printhead of claim 6, wherein the first layer has a first thickness and the second layer has a second thickness, the second thickness being at least three times greater than the first thickness.

8. The printhead of claim 7, wherein the first thickness is between approximately 20 Angstroms and 100 Angstroms and the second thickness is between approximately 0.2 micrometers and 0.5 micrometers.

9. The printhead of claim 6, wherein the first layer includes hafnium oxide and the second layer includes an ink impervious material.

10. The printhead of claim 6, wherein the second layer includes at least one of aluminum oxide, silicon dioxide, or tantalum.

11. The printhead of claim 1, wherein the first material or the second material includes at least one of silicon, SU-8, or Epoxy Molding Compound (EMC).

12. The printhead of claim 1, wherein the substrate assembly further includes a third substrate composed of a third material different than the first material and the second material, the third substrate having a third wall defining the fluid feed path, the third substrate coupled to at least one of the first substrate or the second substrate, and the third material having a third wettability characteristic that is different than the first wettability characteristic and the second wettability characteristic, and wherein the coating is provided on the third wall to harmonize the first wettability characteristic, the second wettability characteristic and the third wettability characteristic.

13. The printhead of claim 12, wherein the first wall of the first substrate defines the nozzle of the printhead, the second wall of the second substrate defines a feed hole in fluid communication with the nozzle, and the third wall of the third substrate defines a slot to receive fluid from a fluid reservoir, the slot being in fluid communication with the nozzle.

14. The printhead of claim 13, wherein the first substrate is composed of SU-8, the second substrate is composed of silicon, and the third substrate is composed of an epoxy molding compound (EMC).

15. A fluid ejection device comprising:

a substrate assembly defining an ink feed path, the substrate assembly including:

a silicon substrate defining a first surface;

an SU-8 layer formed on the silicon substrate, the SU-8 layer defining a second surface; and an epoxy molding compound (EMC) substrate coupled to the silicon substrate and the SU-8 layer, the EMC substrate defining a third surface, the first surface of the silicon substrate, the second surface of the SU-8 layer and the third surface of the EMC substrate defining the ink feed path;

a protective coating provided on first, second and third surfaces defining the ink feed path to protect the ink feed path from ink attack, the protective coating having a first thickness; and a hafnium oxide coating provided on the protective coating along the ink feed path to harmonize a wettability characteristic of the ink feed path defined by the silicon substrate, the SU-8 layer and the EMC substrate, the hafnium oxide coating having a second thickness that is less than the first thickness.

16. The fluid ejection device of claim 15, wherein the protective coating includes at least one of aluminum oxide, silicon dioxide, or tantalum.

17. The fluid ejection device of claim 15, wherein the protective coating is provided between the surfaces of the substrate assembly defining the ink feed path and the hafnium oxide coating.

18. The fluid ejection device of claim 15, wherein the first thickness is approximately between 150 and 250 Angstrom, and the second thickness is approximately 50 Angstrom.

19. A printhead comprising:

a substrate assembly defining a fluid feed path, the substrate assembly including:

an SU-8 layer defining a firing chamber and a nozzle to expel fluid therefrom;

a silicon layer to define a feed hole in communication with the firing chamber; and an epoxy molding compound layer to define a slot to fluidly couple a fluid reservoir and the nozzle via the feed hole and the firing chamber; and a wettability coating formed on surfaces of the SU-8 layer, the silicon layer and the epoxy molding compound layer that define the nozzle, the firing chamber, the feed hole and the slot of the fluid feed path, the wettability coating to homogenize wettability characteristics across an entirety of the fluid feed path defined by the SU-8 layer, the silicon layer, and the epoxy molding compound layer.

20. The printhead of claim 19, wherein the wettability coating is less than 40 Angstrom.

* * * * *